US005368365A

United States Patent [19]

Feldberg

[11] Patent Number: 5,368,365

[45] Date of Patent: Nov. 29, 1994

[54] ADJUSTABLE ARM REST ASSEMBLY

[75] Inventor: Saul Feldberg, Don Mills, Canada

[73] Assignee: Global Upholstery Company, Downsview, Canada

[21] Appl. No.: 50,799

[22] Filed: Apr. 22, 1993

[30] Foreign Application Priority Data

Apr. 23, 1992 [CA] Canada ..... 2066928

[51] Int. Cl.[5] ..... A47C 7/54

[52] U.S. Cl. ..... 297/411.36; 297/411.38

[58] Field of Search ..... 297/411.36, 411.38, 297/353

[56] References Cited

U.S. PATENT DOCUMENTS

| | | | |
|---|---|---|---|
| 4,657,305 | 4/1987 | Meiller | 297/411.36 |
| 4,659,135 | 4/1987 | Johnson | 297/411.36 X |
| 4,674,790 | 6/1987 | Johnson | 297/411.36 X |
| 5,143,422 | 9/1992 | Althofer et al. | 297/411.36 |
| 5,265,938 | 11/1993 | Melhuish et al. | 297/411.36 |

*Primary Examiner*—Peter R. Brown
*Attorney, Agent, or Firm*—McFadden, Fincham

[57] ABSTRACT

An adjustable arm rest assembly comprises an arm rest; a horizontal plane attitude adjustment, adapted to support the arm rest; a vertical elevation adjustment; and, an arm rest bracket. The vertical elevation adjustment is adapted to be pivotally connected to the horizontal plane attitude adjustment to cooperably facilitate hinged adjustment of the horizontal attitude of the arm rest. The horizontal plane attitude adjustment and the vertical elevation adjustment have co-operable detent and block members adapted to be mutually resiliently secured in ones of a plurality of operably aligned registers corresponding to ones of a selectable plurality of horizontal attitudes for the arm rest. In operation, the detent and block are positioned in mutually resiliently biased, releasably locked interfering relation to thereby releasably fix a relative hingedly interconnected positioning between the horizontal plane adjustment and the vertical elevation adjustment corresponding to a selected horizontal attitude of the arm rest. The arm rest frame bracket is adapted to receive the vertical elevation adjustment in vertically slidably positionable relation thereon, to cooperably facilitate adjustment of the vertical positioning of the arm rest. Respective co-operable locking members on the bracket and the vertical elevation adjustment are adapted to be selectively engaged in resiliently biased mutually interfitting register to thereby releasably interferingly secure the bracket and the vertical elevation adjustment in a predetermined vertically fixed position corresponding to a desired vertical position of the arm rest.

9 Claims, 3 Drawing Sheets

ADJUSTABLE ARM REST ASSEMBLY

FIELD OF THE INVENTION

The present invention relates to vertically and horizontally adjustable arm rests for ergonometrically designed furnishings, and especially for utilitarian furnishings, such as chairs designed for beauty parlour applications.

BACKGROUND OF THE INVENTION

With the growing recognition that comfort and posture considerations have received in public health circles, and the population at large, there has been a collateral increase in the demands for functional, ergonometric furnishing designs. This is especially true in specialty furnishing markets, such as the beauty salon services industry. Occupants of chairs in such a salon are typically called upon to adopt and hold postures that, if unsupported, can quickly grow uncomfortable and tiring. A need exists for furnishings that are adapted to conveniently and comfortably facilitate those postures, and any necessary changes between them.

SUMMARY OF THE INVENTION

In accordance with the present invention there is provided an adjustable arm rest assembly comprising an arm rest and a horizontal plane attitude adjustment, adapted to support the arm rest.

A vertical elevation adjustment is adapted to be pivotally connected to the horizontal plane attitude adjustment to thereby cooperably facilitate hinged adjustment of the horizontal attitude of the arm rest, and in a particular the forward/rearward pitch thereof. The horizontal plane attitude adjustment and the vertical elevation adjustment have co-operable detent and block means adapted to be mutually resiliently secured in ones of a plurality of operably aligned registers corresponding to ones of a selectable plurality of horizontal attitudes for the arm rest. With this arrangement the arm rest is releasably secured in a selected one attitude, with the detent and block positioned in mutually resiliently biased mutually interfering relation, to thereby releasably fix the hingedly interconnected positions of the horizontal plane adjustment and the vertical elevation adjustment corresponding to a selected horizontal attitude of the arm rest.

An arm rest frame bracket is also included. It is adapted to receive the vertical elevation adjustment in vertically slidably positionable relation thereon, to cooperably facilitate adjustment of the vertical positioning of the arm rest. Respective co-operable locking members on the bracket and the vertical elevation adjustment are adapted to be selectively engaged in resiliently biased mutually interfitting register to thereby interferingly secure the bracket and the vertical elevation adjustment in a predetermined vertically fixed position corresponding to a desired vertical position of the arm rest.

In accordance with the present invention as summarized in the forgoing, there is provided an adjustable arm rest assembly having both height and forward and rearward pitch adjustment, to readily facilitate changes in posture of the occupant, as may be required, for example, in furnishings used in beauty salons or the like.

DETAILED DESCRIPTION OF A PREFERRED EMBODIMENT

Introduction to the Drawings

Over the course of the following description of a particular embodiment of the present invention, reference will be made to the appended drawings, in which.

Figure 4B:
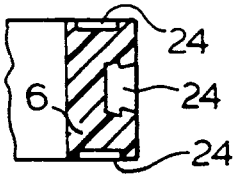
FIG. 4 is a sectional view through the vertical elevation adjustment.
Figure 4:
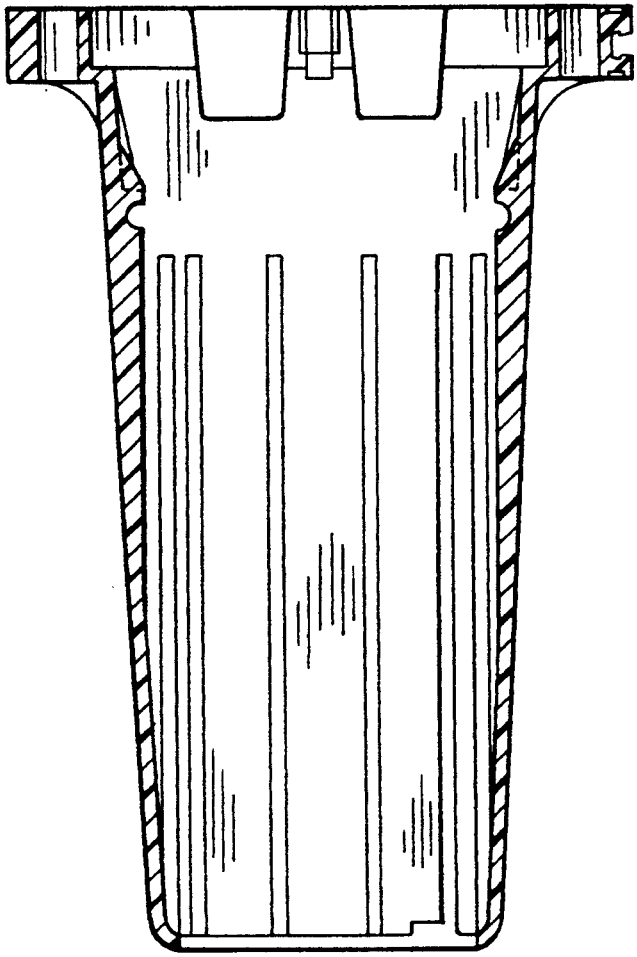
Figure 4A:
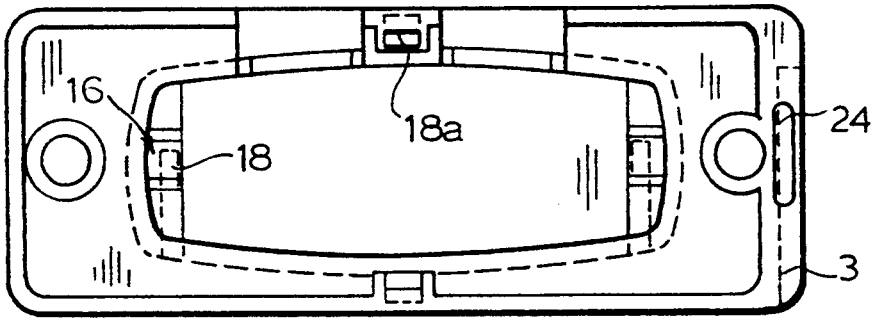
Figure 5:
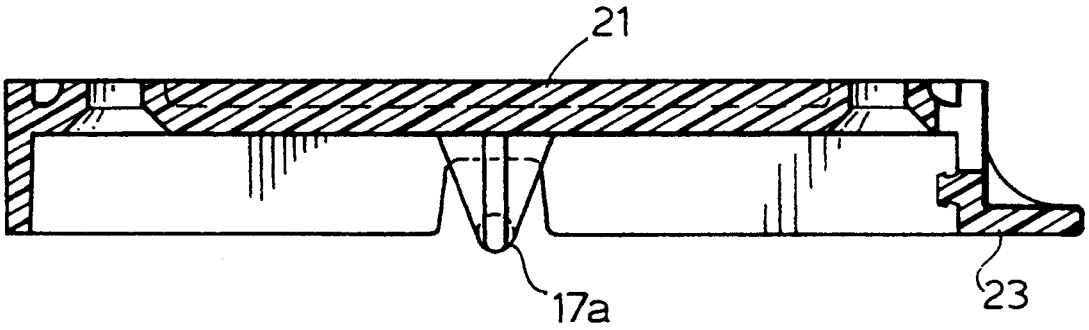
Figure 5A:
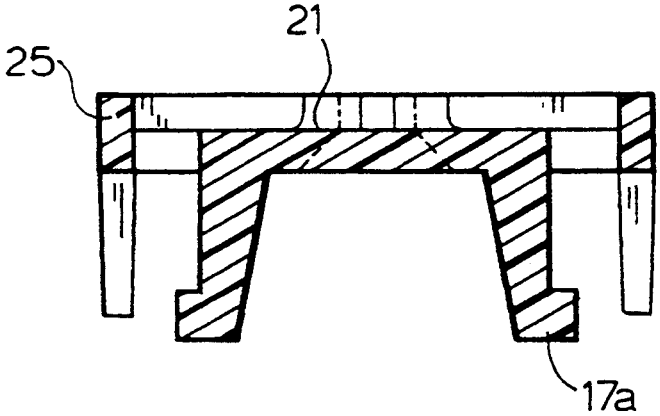
Figure 5B:
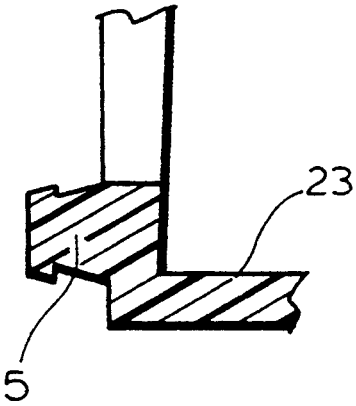

FIG. 4*a* is a top plan view of the vertical elevation adjustment, looking down the throat thereof;

FIG. 4*b* is a detailed view of the detent feature of the vertical elevation adjustment;

FIG. 5 is an elevated side view in section through the horizontal attitude adjustment;

FIG. 5*a* is an end sectional view of the horizontal attitude adjustment depicted in FIG. 5; and, FIG. 5*b* is a detailed view of the horizontal attitude adjustment's block, which is adapted to cooperably lock into the detent feature which is the subject of FIG. 4*b*.

Referring first to the drawings in general, there is shown an adjustable arm rest assembly comprising: an arm rest 1; a horizontal plane attitude adjustment 2, adapted to support the arm rest 1; a vertical elevation adjustment 3; end, an arm rest frame bracket 4.

The vertical elevation adjustment 3 is adapted to be pivotally connected to the horizontal plane attitude adjustment 2 to cooperably facilitate hinged adjustment of the horizontal attitude of the arm rest 1. More particularly, the horizontal plane attitude adjustment 2 and the vertical elevation adjustment 3 have operable detent 5 and block 6 means that are adapted to be mutually resiliently secured in ones of a plurality (three) of operably aligned registers corresponding to ones of a selectable plurality (three) of horizontal attitudes for the arm rest 1. When in the selected one of the possible positions, the arm rest 1 is releasably secured in a selected one attitude, with the detent 5 and block 6 positioned in mutually resiliently biased, releasably locked interfering relation. This engagement of the detent 5 and block 6 releasably fixes the relative hingedly interconnected positioning between the horizontal plane adjustment 2 and the vertical elevation adjustment 3, which interconnected positioning corresponds to the selected horizontal attitude of said arm rest 1.

The arm rest frame bracket 4 is adapted to receive the vertical elevation adjustment 3 in vertically slidably positionable relation thereon. This arrangement cooperably facilitates the adjustment of the vertical positioning of the arm rest 1. In particular, respective co-operable locking members, shown generally by reference numeral 7 on the bracket 4 and the vertical elevation adjustment 3, are adapted to be selectively engaged in resiliently biased mutually interfitting register to thereby releasably interferingly secure the bracket 4 and the vertical elevation adjustment 3 in a predetermined vertically fixed position corresponding to a desired vertical positioning or more precisely "elevation" of the arm rest 1.

Figure 2:
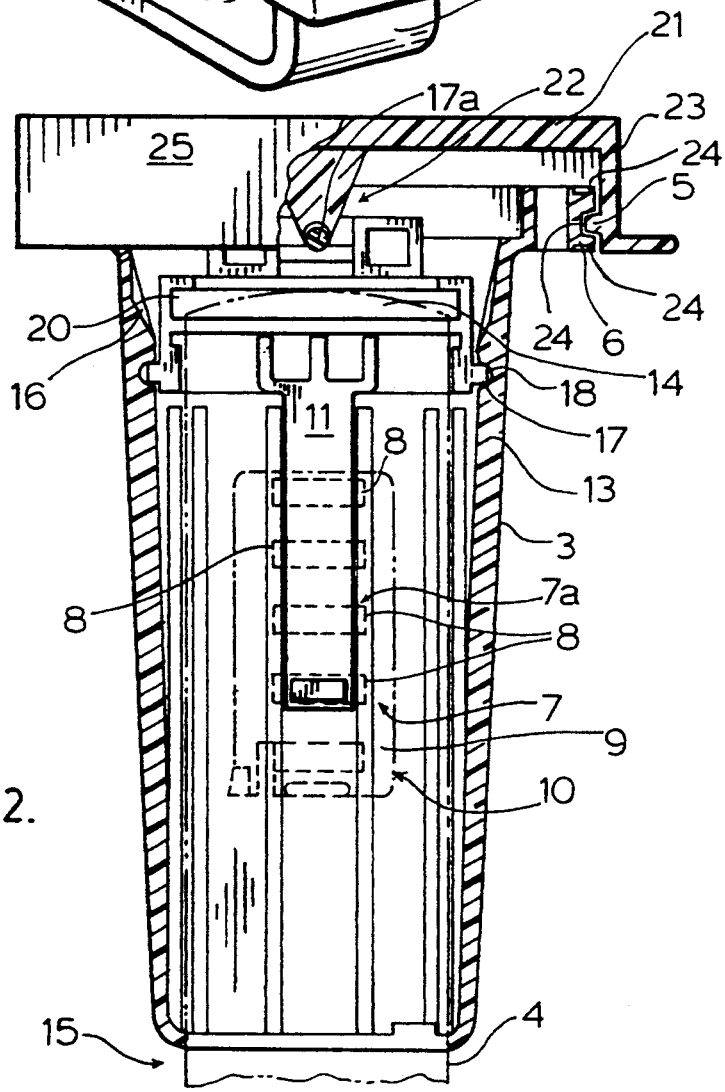
FIG. 2 is a partially cut away and sectional view of the arm rest depicted in FIG. 1.
Figure 3:
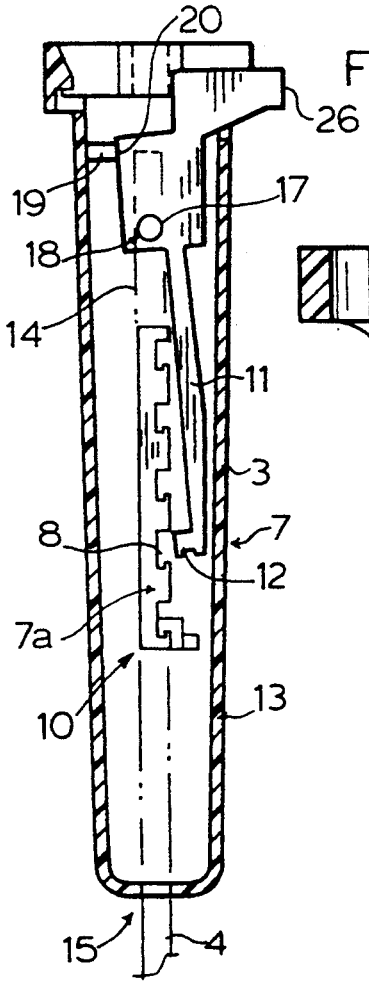
FIG. 3 is another view of the arm rest illustrated in FIG. 1, in a cross-section taken a right angles to the section shown in FIG. 2.

Referring now in particular to FIG. 2, the adjustable arm rest assembly, the co-operable locking members 7 on the bracket 4 comprise a rack *7a* having a linearly arrayed plurality of openings 8 therein, arranged along a vertically oriented length of the bracket 4. The preferred rack *7a*, as illustrated, comprises a panel 9 adapted to be frictionally engaged in a corresponding opening 10 in bracket 4.

The cooperating locking member on the vertical elevation adjustment 3 comprise a lever 11 operable insert 12 adapted to be resiliently biased into inserted relation, aligned in a selected register with one of the rack openings 8. Insert 12 is selectively pivotally removable out of that inserted relation through manual operation of lever 11, to permit sliding relative re-positioning of the bracket 4 and the vertical elevation adjustment 3. Selective reinsertion of the insert 12 into another registratedly aligned opening 8 axially spaced apart from the previously engaged one of the openings 8. This permits relative vertical adjustment of the arm rest 1 elevation.

The vertical elevation adjustment 3 is shaped as a sleeve 13 adapted to surroundingly receive the elongated bar-shaped free-end 14 of bracket 4, and the adjacent vertically oriented length 15, thereof. Sleeve 13 includes a pair of mutually opposed, axially extending, interior side wall grooves 16 adapted to guidingly receive respective ones of a pair of pivots 17 arranged on opposed sides of the lever 11. Grooves 16 terminate in inset pivot receiving holes 18, and lever pivots 17 are adapted to be axially slidingly inserted into the grooves 16 and snap fitted (being preferably constructed from a resiliently deformable plastic material), into the pivot receiving holes 18.

Lever 11 is adapted to engage a spring 19, which is operable to normally bias the insert 12 towards the rack openings 8. The illustrated spring 19 is it leaf spring acting against the lever 11, along a surface portion 20 thereof which is axially spaced apart from the insert 12, with the pivots 17 disposed axially intermediately therebetween.

Referring now to FIGS. 5, *5a*, and *5b*, the horizontal attitude adjustment 2 is illustrated as an elongated forward and rearward pitch adjustment body 21 having a centrally located pivot attachment 22, which is adapted to engage with the vertical elevation adjustment 3, in mutually hinged relation therewith.

The pitch adjustment body 21 further comprises an end mounted resiliently deflectable arm 23 which supports block 6 at a free end of arm 23. The deflectable arm 23 is operable to interferingly engage with ones of a plurality of co-operable detents 24 borne on a corresponding end of the vertical elevation adjustment 3.

The body 21 of the horizontal plane attitude adjustment 2 is configured generally as a cap 25, and is adapted to engage the vertical elevation adjustment sleeve 13 in superposed relation, with the pair of laterally opposed pivots *17a* resiliently deformably mounted on opposed sides thereof. The opposed pivots *17a* are adapted to resiliently engage the correspondingly positioned pivot holes *18a* in the sleeve 13. The cap 25 is adapted to be fixedly secured to the arm rest 1 with fastening means (not shown).

Figure 1:
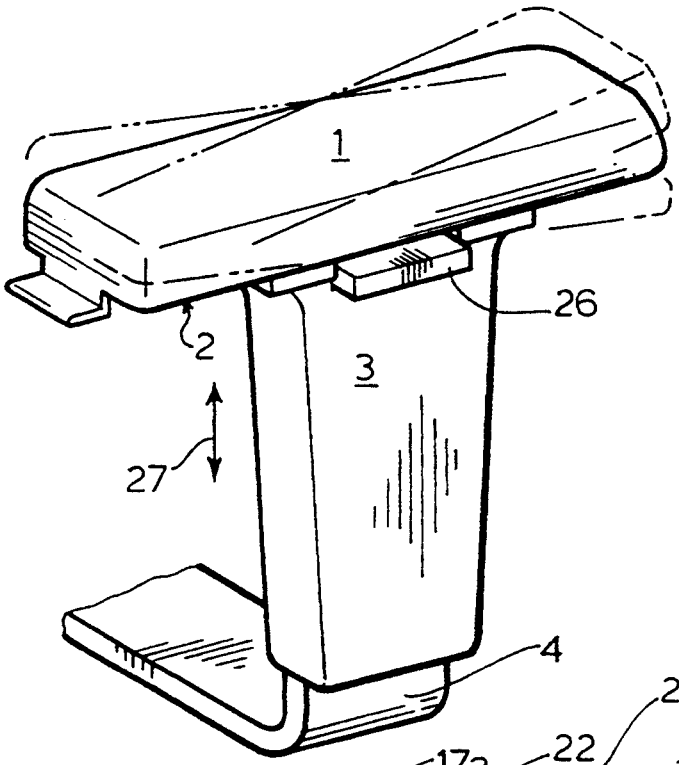
FIG. 1 is a perspective view of an assembled adjustable arm rest according to the present invention.

In operation, and as shown in FIG. 1, the outward deflection of arm 23, out of its normally engaged bias, frees the block 6 from detents 24, so that the forward and rearward pitch of arm rest 1 can be selectively adjusted, about the pivoted connection between the horizontal plane attitude adjustment 2, and the vertical elevation adjustment 8. Similarly, depressing the exposed end 26 of lever 11 against the normal bias of the spring 19, permits the rotation of lever 11 about pivots 17. This releases insert 12 from one of the openings 8. This action then frees sleeve 13 to selectively slide in the directions indicated by arrow 27. This allows an operator to vertically reposition the arm rest 1 at another selected vertical elevation, predetermined by one of the cooperative registers of the openings 8 and insert 12. Releasing the exposed end 26 allows the spring 19 to relax, and engage the insert 12 to engage an aligned opening 8.

I claim:

1. An adjustable arm rest assembly comprising:

an arm rest;

a horizontal plane attitude adjustment means for supporting said arm rest;

a vertical elevation adjustment means pivotally interconnected through a pivot to said horizontal plane attitude adjustment means to co-operably facilitate hinged adjustment of the horizontal attitude of said arm rest, wherein said horizontal plane attitude adjustment means has a first detent/block means and said vertical elevation adjustment means has a second detent/block means that is co-operable with said first detent/block means, wherein said horizontal plane attitude adjustment means comprises an elongated forward and rearward pitch adjustment body with said pivot arranged on a centrally located pivot attachment and engaged with said vertical elevation adjustment means, in mutually hinged relation therewith, and said pitch adjustment body further comprises and end mounted resiliently deflectable arm supporting said first detent/block means at a free end of said arm, where it is operable to interferingly engage with said second detent/block means borne on a corresponding end of said vertical elevation adjustment means to thereby releasably fix said horizontal plane adjustment means relative to said vertical elevation adjustment means;

an arm rest frame bracket, adapted to receive said vertical elevation adjustment means in vertically slidably positionable relation thereon, to co-operably facilitate adjustment of the vertical positioning of said arm rest, wherein respective co-operable locking members on said bracket and said vertical elevation adjustment means are adapted to be selectively engaged in resiliently biased mutually interfitting registration to thereby releasably secure said bracket and said vertical elevation adjustment means in a predetermined vertically fixed position.

2. The adjustable arm rest assembly according to claim 1 wherein said co-operable locking members on said bracket and said vertical elevation adjustment means comprise, respectively:

a rack having a linearly arrayed plurality of openings therein, arranged along a vertically oriented length of said bracket; and, a lever operable insert adapted to be resiliently biased into inserted relation, aligned in a selected register with one of said rack openings, said selectively pivotally removable out of said inserted relation through manual operation of said lever, to permit sliding relative re-positioning of said bracket and said vertical elevation adjustment means, with selective reinsertion of said insert into another registratedly aligned opening axially spaced apart from said one of said openings, to thereby permit relative vertical adjustment of said arm rest elevation.

3. The assembly according to claim 1 wherein said vertical elevation adjustment means comprises a sleeve adapted to surroundingly receive an elongated bar-shaped free-end of said bracket, and the adjacent vertically oriented length thereof.

4. The assembly according to claim 3 wherein said sleeve includes a pair of mutually opposed, axially extending interior side wall grooves adapted to guidingly receive respective ones of a pair of pivots arranged on opposed sides of said lever, said grooves terminating in inset pivot receiving holes, and wherein said lever pivots are adapted to be slidingly inserted into said grooves and snap fitted into said pivot receiving holes.

5. The assembly according to claim 4 wherein said insert is biased of a spring means towards said rack openings.

6. The assembly according to claim 5 wherein said spring means is a leaf spring acting against said lever, along a surface portion thereof axially spaced apart from said insert, with said pivots disposed intermediately therebetween.

7. The assembly according to claim 6 wherein said horizontal plane attitude adjustment means is a cap adapted to engage said vertical elevation adjustment sleeve in superposed relation, with a pair of laterally opposed pivots resiliently deformably mounted on opposed sides thereof, said laterally opposed pivots being adapted to resiliently engage correspondingly positioned pivot holes in said sleeve.

8. The assembly according to claim 7 wherein said cap is adapted to be fixedly secured to said arm rest with fastening means.

9. The assembly according to claim 8 wherein said rack comprises a panel adapted to be frictionally engaged in a corresponding opening in said bracket.

* * * * *